US006883256B2

(12) United States Patent
Mazzarolo

(10) Patent No.: US 6,883,256 B2
(45) Date of Patent: Apr. 26, 2005

(54) STRUCTURE FOR LIMITING MOVEMENTS OF THE LEG-PIECE OF A MOTORCYCLE BOOT

(75) Inventor: Gabriele Mazzarolo, Coste di Maser (IT)

(73) Assignee: Alpinestars Research Srl., Trevison (IT)

( * ) Notice: Subject to any disclaimer, the term of this patent is extended or adjusted under 35 U.S.C. 154(b) by 0 days.

(21) Appl. No.: 10/829,030

(22) Filed: Apr. 21, 2004

(65) Prior Publication Data

US 2004/0194350 A1 Oct. 7, 2004

Related U.S. Application Data

(62) Division of application No. 10/031,551, filed as application No. PCT/EP01/05284 on May 9, 2001, now Pat. No. 6,725,577.

(30) Foreign Application Priority Data

May 23, 2000 (IT) ..... MI2000A1137

(51) Int. Cl.[7] ..... A43B 7/20
(52) U.S. Cl. ..... 36/131; 36/89
(58) Field of Search ..... 36/89, 118.2, 118.4, 36/118.7, 118.8, 131

(56) References Cited

U.S. PATENT DOCUMENTS 3,303,584 A 2/1967 Werner et al.
3,906,645 A * 9/1975 Heckel ..... 36/131
3,945,134 A 3/1976 Ramer
4,062,133 A 12/1977 McGee et al.
4,563,825 A 1/1986 Tesser
4,602,443 A 7/1986 Spademan
4,615,128 A 10/1986 Borsol
4,882,858 A 11/1989 Signori
4,918,842 A 4/1990 Lederer
5,675,917 A * 10/1997 Falguere et al. ..... 36/117.2

FOREIGN PATENT DOCUMENTS

| | | |
|---|---|---|
| EP | 0813825 | 12/1997 |
| FR | 2656776 | 7/1991 |
| FR | 2800976 | 5/2001 |
| WO | 98/31247 | 7/1998 |

* cited by examiner

*Primary Examiner*—Ted Kavanaugh
(74) *Attorney, Agent, or Firm*—Katten Muchin Zavis Rosenman

(57) ABSTRACT

A structure associated with a motorcycle boot which is designed to restrict, in the event of accidental falls followed by contact at high speed with the ground, the movements of a leg-piece of the boot with respect to the axis of a heel-piece, comprises a first hinge, which is angularly movable in a substantially unlimited manner and axially movable between two stopping means, and second hinge which is movable only angularly in a restricted manner. Alternatively, the first and second hinges can be formed of elastomeric materials.

5 Claims, 5 Drawing Sheets

STRUCTURE FOR LIMITING MOVEMENTS OF THE LEG-PIECE OF A MOTORCYCLE BOOT

This is a division of U.S. patent application Ser. No. 10/031,551, filed Jan. 18, 2002 now U.S. Pat. No. 6,725,577, which was filed under 35 U.S.C. §371 from International Patent Application PCT/EP01/05284, filed May 9, 2001.

FIELD OF THE INVENTION

The present invention relates to a structure intended for restricting the movements in the main directions, i.e. longitudinal, rotary and torsional directions, of the leg-piece of an a boot with respect to the axis of an associated heel-piece in order to protect a motorcyclist's lower limbs.

BACKGROUND OF THE INVENTION

The dangers of severe injuries deriving from accidental impacts and falls are well known by people who practise motorcycling. The injuries can often involve the lower limbs, in particular the feet, and result from seemingly trivial manoeuvres or accidents, like setting a foot on the ground while the vehicle is travelling at high speed. In these circumstances the foot is subjected to severe stresses and, if it were not protected, quite severe consequences, such as fractures or other damages to the bones, and tearing of the Achilles tendon or of the ligaments in the region of malleoli would take place.

A need therefore exist of preventing, or at least limiting as far as possible, the said injuries which is satisfied by conventional boots comprising a rigid shell, enclosing the foot, and a leg-piece which is also rigid—enclosing the leg and hinged on the shell. During an accident these parts are obviously positioned between the limb to be protected and the obstacles encountered with the result of dampening the impacts and deflecting their action.

Even if motorcycle boots of this type are already available which greatly limit the possibility of bone fractures in the leg and foot and, when they are designed so as to surround at a sufficient extent the limb, are suitable for the protection against excessive torsional angles, no structure is presently available which is capable of restricting certain relative movements of the foot and leg during a motorcycling accident that lead to excessive bending angles between the foot and the leg, either in the forward or backward direction.

SUMMARY OF THE INVENTION

The main object of the present invention is therefore to disclose a structure for the use in a motorcycle boot which is capable of restricting the relative movements, especially the rotary movements, between the foot and the leg to be protected.

The above mentioned object is achieved by a structure according to the present invention comprising: at least one leg-piece, close to and hinged on at least one heel-piece forming part of a rigid shell, characterized in that, close to the heel and between the leg-piece and the heel-piece first hinging means are provided which are angularly movable at a substantially unlimited extent as well as axially movable between two stopping means, and second hinging means which are permitted only a restricted angular movement.

BRIEF DESCRIPTION OF THE DRAWINGS

All the features and the consequent advantages of the invention will emerge more clearly from the following detailed description of some embodiment thereof and from the attached drawings in which.

DETAILED DESCRIPTION OF THE INVENTION

Figure 1:
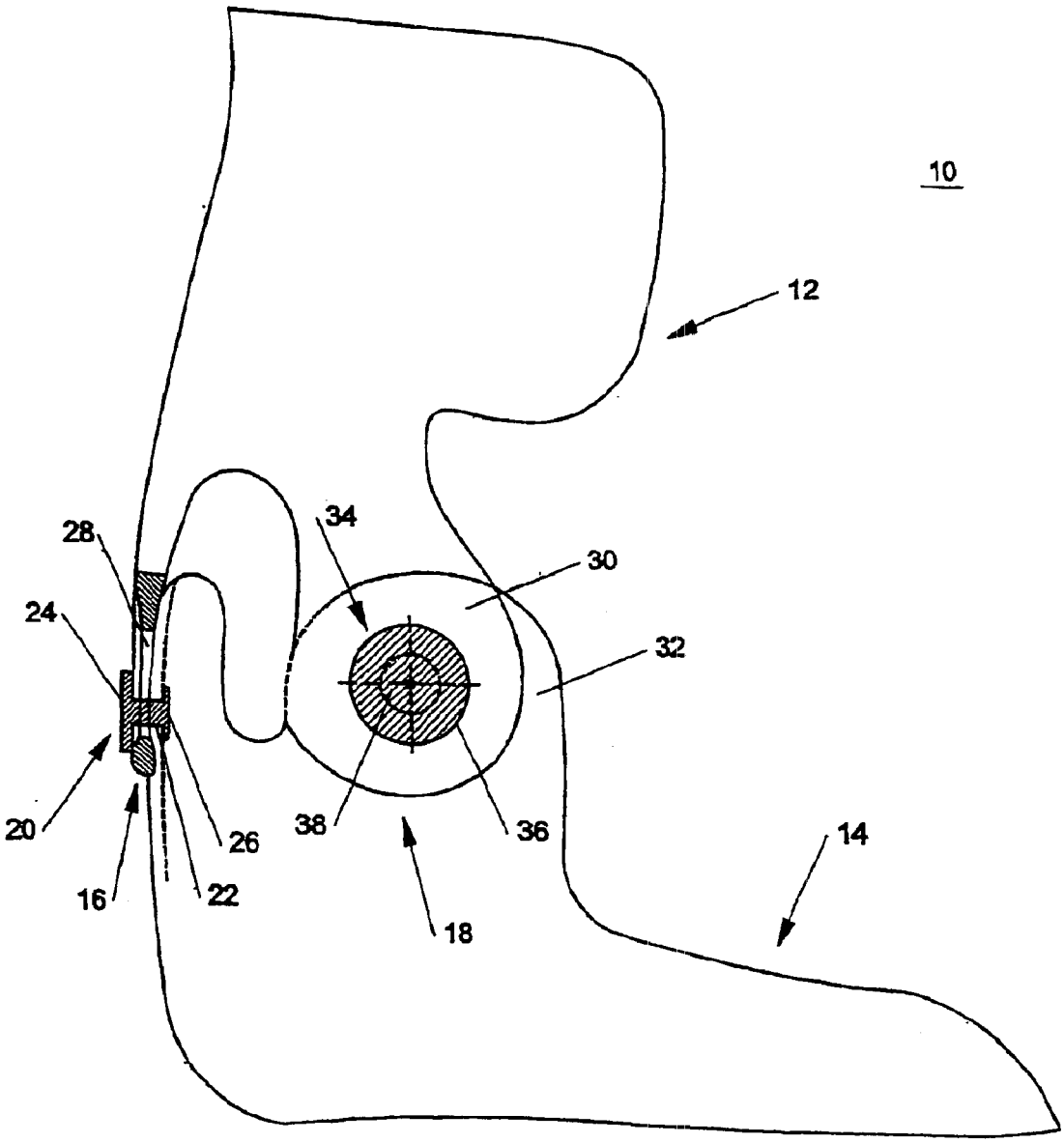
FIG. 1 is a side elevation view of the protective part of a boot according to a first embodiment of the present invention.

In the embodiment of FIG. 1 a structure 10, to be associated with a motorcycling boot (not shown), consists of a leg-piece 12 connected to a heel-piece 14 by means of first rear hinging means 16 and second front hinging means 18. The said first hinging means 16 consist of a fastening stud 20 having a shank 22, an outer enlarged head 24 and an inner enlarged head 26, the shank 22 passing through an axially elongated eyelet 28 provided in the leg-piece 12. The second hinging means 18 comprise a front lug 30 in the lowermost portion of the leg-piece 12, an associated lug 32 in the heel-piece 14 and a stud 34, basically similar to the already mentioned stud 20, which has a narrow shank (not shown), an outer enlarged head 36 and an inner enlarged head (also not shown). The shank of the stud 34 passes through two holes, one in the lug 32 of the heel-piece 14 and another hole 38 in the lug 30 of the leg-piece 12. While the hole in the heel-piece 14 has substantially the same diameter as the shank of the stud 34, the hole in the leg-piece 12 is decidedly bigger than the same shank, although smaller than the outer enlarged head 36. As a consequence a movement is permitted of the lug 30 of the leg-piece 12 with respect to the lug 32 of the heel-piece 14 within the limits set by the mentioned difference in diameter between the hole 38 and the shank of the stud 34.

It shall be appreciated that due to the first hinging means 16 any relative angular movement is allowed between an axis of the leg-piece 12 and an axis of the heel-piece 14 but only an axial movement (namely along the longitudinal axis of the leg-piece 12) is possible within the limits set by the elongated eyelet 28 provided in the leg-piece 12 to the travel of the shank 22 of the stud 20. The relative angular movement between the axes of the leg-piece 12 and the heel-piece 14 is restricted by the said second hinging means 18 which only permit the shank of the stud 34 to move in the backlash between the same and the edges of the hole 38 provided in the lug 30 of the leg-piece 12. Any relative movements in a radial direction between the first hinging means 16 and the second hinging means 18 is substantially prevented by the stud 20 which secures the heel-piece 14 to the leg-piece 12. In this manner, in case of impacts, only restricted relative opening and closing movements of the leg-piece 12 and the heel-piece 14 are permitted, thus reducing the risk of the worst injuries which might occur to the Achilles tendon, the malleolar joints and their ligaments.

Figure 2:
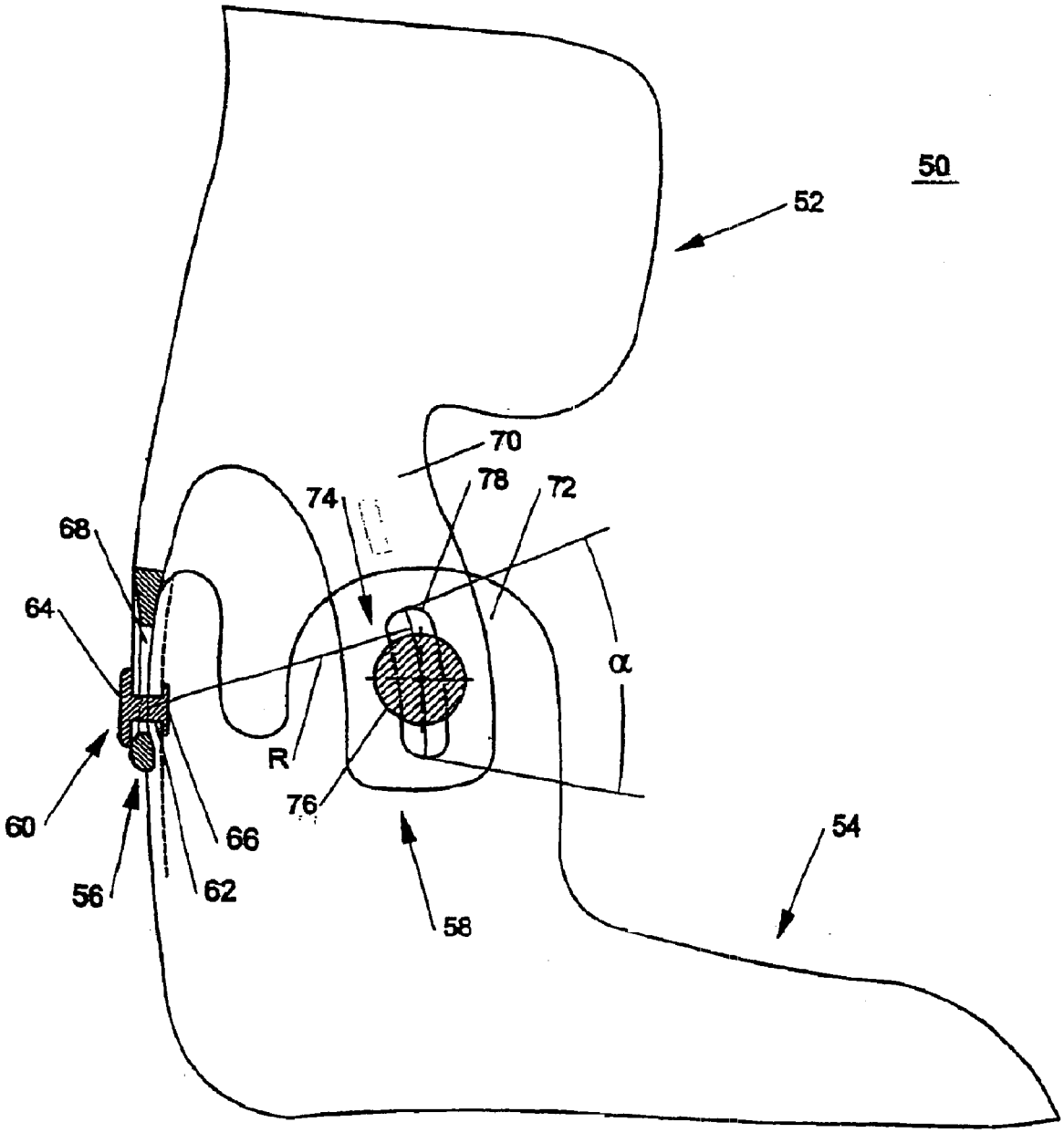
FIG. 2 is similar to FIG. 1 but refers to a second embodiment.

In the second embodiment, as illustrated in FIG. 2, a structure 50 to be associated with a motorcycle boot (not shown) consists of a leg-piece 52 connected to a heel-piece 54 by means of first rear hinging means 56 and second front hinging means 58. The first rear hinging means 56 are the same as in the preceding embodiment, namely consist of a fastening stud 60 with a shank 62, an outer enlarged head 64 and an inner enlarged head 66, the shank 62 passing though an axially elongated eyelet 68 provided in the leg-piece 52. As regards the second hinging means 58, the front lug 70 in the lowermost portion of the leg-piece 52, the associated lug 72 in the heel-piece 54, the stud 74, which has a narrow shank (not shown), an outer enlarged head 76 and an inner enlarged head (also not shown) also are the same as in the embodiment illustrated in FIG. 1. Anyhow, of the two holes which are passed by the shank of the stud 74, the hole provided in the lug 72 of the heel-piece 54 substantially has the same diameter as the shank of the stud 74, while the second hole 78, which is provided in the front lug 70 of the leg-piece 52 and has the shape of an oblong eyelet with the shape of an arc having a radius R and an amplitude $\alpha$ is longer than the said diameter. As a consequence, the second hinging means 58 allow a movement of the leg-piece 52 with respect to the heel-piece 54 along the arched hole 78.

It shall be appreciated from FIG. 2 that due to the first hinging means 56 can allow any relative angular movement is allowed between an axis of the leg-piece 52 and an axis of the heel-piece 54 but only an axial movement (namely along the longitudinal axis of the leg-piece 52) is possible within the limits set by the oblong eyelet 68 to the travel of the shank 62 of the stud 60. The relative angular movement between the axes of the leg-piece 52 and of the heel-piece 54 is restricted by the second hinging means 58 which restrict the travel of the shank of the stud 74 to the angle $\alpha$ along the arched hole 78 provided in the lug 70 of the leg-piece 52. Movements in the radial direction are completely prevented because the shape of the hole 78 prevents variations in the radius R of the arch A. This second embodiment of the invention proves even more effective than the first embodiment as to the limitation of the injuries which might occur to the Achilles tendon, the malleolar joints and their ligaments.

Figure 4:
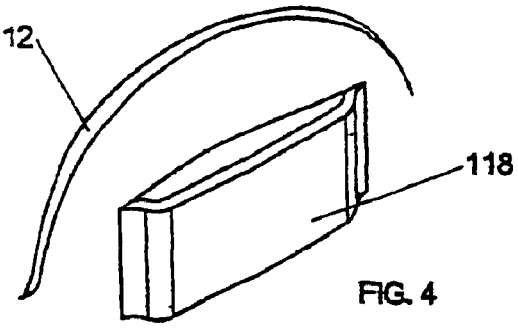
FIGS. 4 and 5 also refer to the said third embodiment and illustrate respectively a partial perspective view of the structure and a partial cross-sectional view of a bridge-piece, formed in the heel-piece, which is suitable to receive an arched tongue, connected to the leg-piece of the second hinging means.
Figure 5:
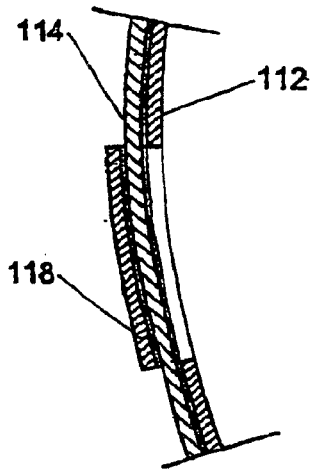
Figure 3:
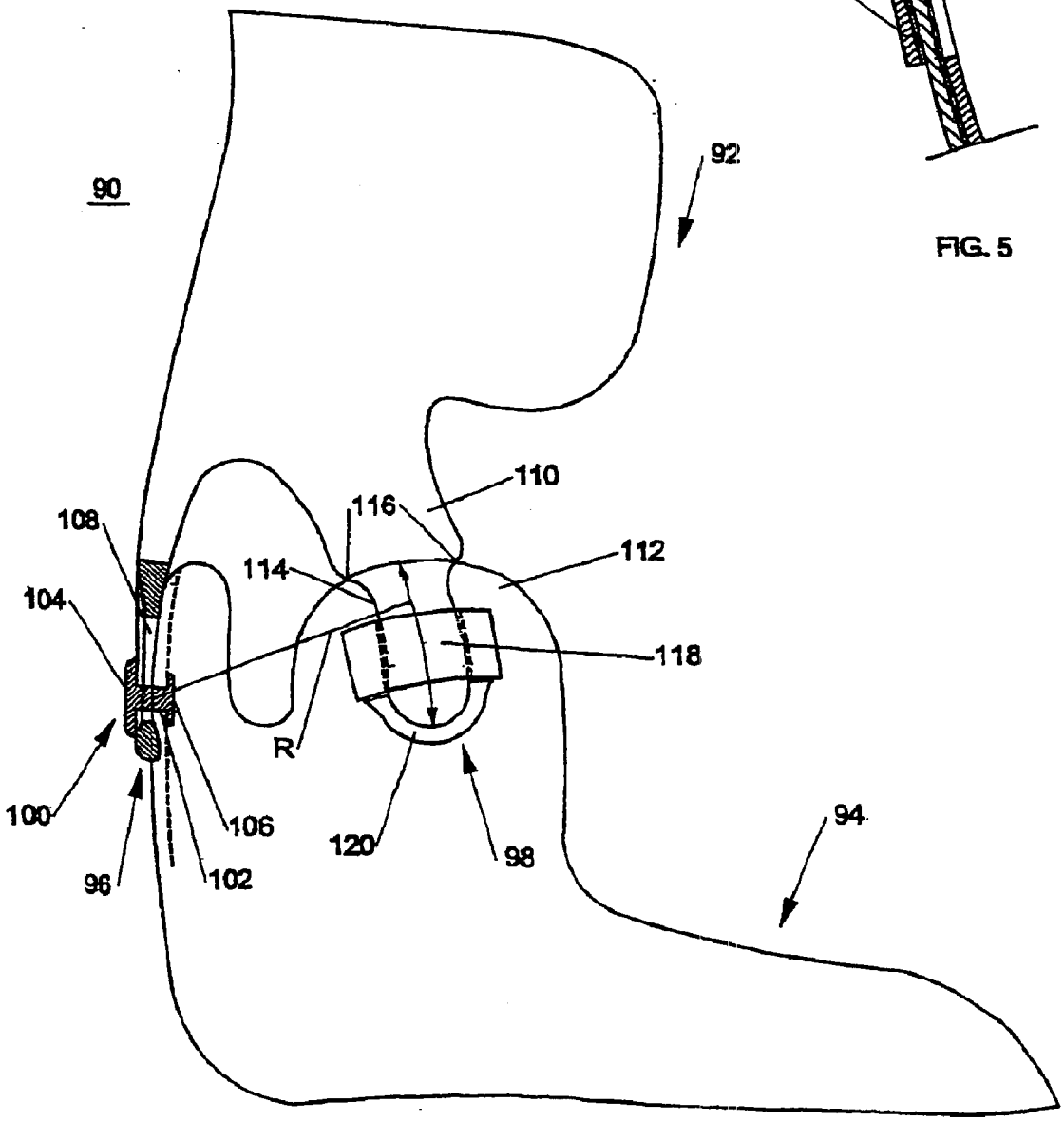
FIG. 3 is similar to FIGS. 1 and 2 but refers to a third embodiment.

With reference now to FIGS. 3, 4 and 5 which illustrate a third embodiment of the invention, a structure 90, to be associated with a motorcycle boot, consists of a leg-piece 92 connected to a heel-piece 94 by means of a first rear hinging means 96 and a second front hinging means 98. As in both embodiments already described, the first hinging means 96 consist of a fastening stud 100 having a shank 102, an outer enlarged head 104 and an inner enlarged head 106, the shank 102 passing through an axially elongated eyelet 108 provided in the leg-piece 92. However, the second hinging means 98, positioned between a lug 110 of the leg-piece 92 and an underlying lug 112 of the heel-piece 94, consist of an arched tongue 114, of a mean radius R, connected to the lug 110 by two abutments 116 and passing under a bridge-piece 118 obtained by an upraised portion of the heel-piece 94, as is shown in detail in FIGS. 4 and 5. The bottom end 120 of the arched tongue 114, which is thicker, prevents the tongue 114 from coming out of the bridge-piece 118. The shape and the length of the tongue 114 allow a movement of the leg-piece 92 with respect to the heel-piece 94 along the mean line A of the tongue 114 which is restricted at the top by the abutments 116 and at the bottom by the thicker end 120.

It shall be appreciated that in the third embodiment illustrated in FIGS. 3, 4 and the hinging means 96 allow any relative angular movement between an axis of the leg-piece 92 and an axis of the heel-piece 94 but only an axial movement (namely along the longitudinal axis of the leg-piece 92) restricted by the travel of the shank 102 in the elongated eyelet 108 formed in the leg-piece 92. The relative angular movement between the axes of the leg-piece 92 and the heel-piece 94 is restricted by the hinging means 98 which limit the travel of the arched tongue 114 to the length of the mean line A, of a radius R, defined between the shoulders 116 and the thicker zone 120. Movements in the radial direction are completely prevented since the shape of the tongue 114 under the bridge-piece 118 prevents any variation of the said radius R. The efficiency of the third embodiment of the invention is substantially the same as the efficiency of the second one, illustrated in FIG. 2, as regards the limitation of the injuries which may occur to the Achilles tendon, the malleolar joints and their ligaments. However, the elimination of studs in the hinging means 98—which may penetrate into the foot or the leg—bears the additional advantage of making the structure even safer in the event of impacts which cause the deformation of the leg-piece 92 or the heel-piece 94.

Figure 6:
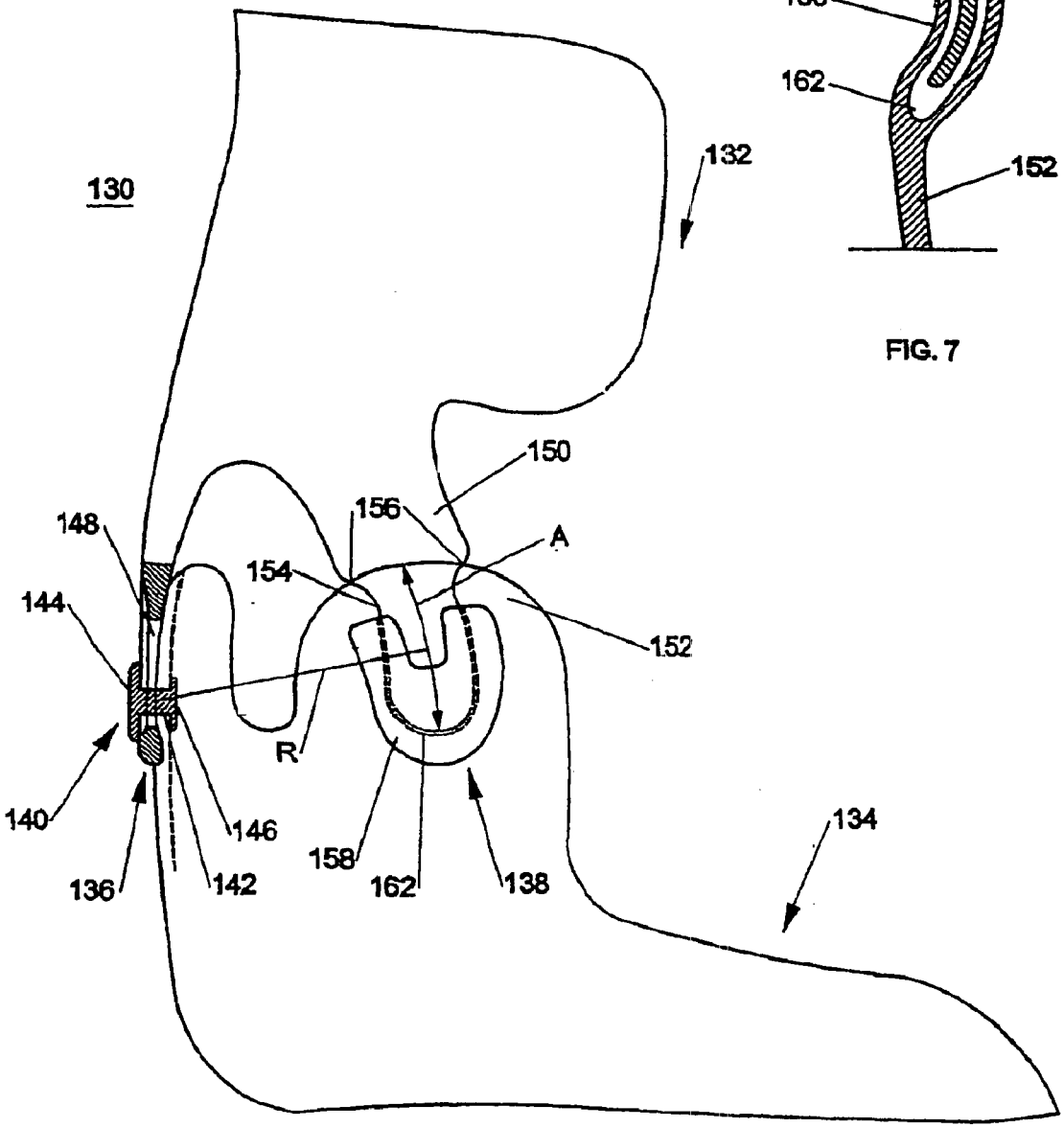
FIG. 6 is similar to FIGS. 1 to 3 but refers to a fourth embodiment.
Figure 7:
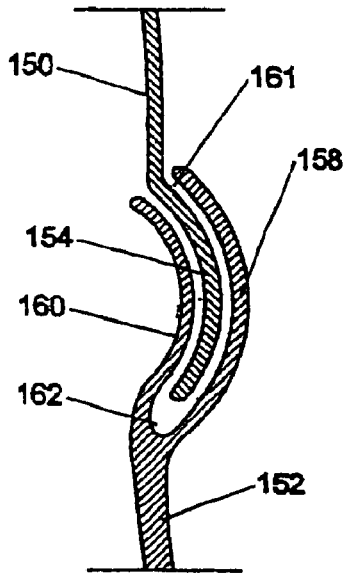
FIG. 7 also refers to the said fourth embodiment and is a partial cross-sectional view of a tongue and pocket assembly, having a spherical shape, to realise the second hinging means thereof.

With reference to FIGS. 6 and 7 illustrating a fourth embodiment of the invention, a structure 130, to be associated with a motorcycle boot, consists of a leg-piece 132 connected to a heel-piece 134 by means of first rear hinging means 136 and second front hinging means 138. As in the previously described three embodiments, the first hinging means 136 consist of a fastening stud 140 with a shank 142, an outer enlarged head 144 and an inner enlarged head 146, the shank 142 passing through an axially elongated eyelet 148 provided in the leg-piece 132. However, the second hinging means 138, positioned between a lug 150 of the leg-piece 132 and an underlying lug 152 of the heel-piece 134, are formed by an arched tongue 154, of a mean radius R, which can be joined to the lug 150 by two widened zones 156 and inserted in a pocket 161, which is formed inside the lug 152 of the heel-piece 134 by two adjacent walls 158 and 160 joined in a zone 162 so as to form the bottom of a pocket, as is shown in detail in FIG. 7.

It shall be appreciated from FIGS. 6 and 7 that the hinging means 136 allow any relative angular movement between an axis of the leg-piece 132 and an axis of the heel-piece 134 but only an axial movement (namely along the longitudinal axis of the leg-piece 132) restricted by the travel of the shank 142 in the elongated eyelet 148 provided in the leg-piece 132. The relative angular movement between the axes of the leg-piece 132 and the heel-piece 134 is restricted by the hinging means 138 provided that during closing the travel of the arched tongue 154 is restricted to the length of the mean line A, of a radius R, defined between the two widened zones 156 and the bottom 162 of the pocket 161 of the heel-piece 134 and during opening the travel is dampened owing to the spherical curved shape of the tongue 154 which rubs against adjacent walls 158 and 160. Movements in the radial direction are completely prevented because the shape of the tongue 154 inside the pocket under the bridge-piece 118 prevents any variation of the radius R. This embodiment of the invention is substantially as effective as the third one, illustrated in FIGS. 3, 4 and 5, as regards the limitation of the injuries which may occur to the Achilles tendon, the malleolar joints and their ligaments. In addition, the dampened angular travel during opening of the arched tongue 154 entails a gradual resistance to the opening movement instead of a harsh stop as provided by the thicker bottom end 120 of the arched tongue 114 in the previous embodiment.

Figure 8:
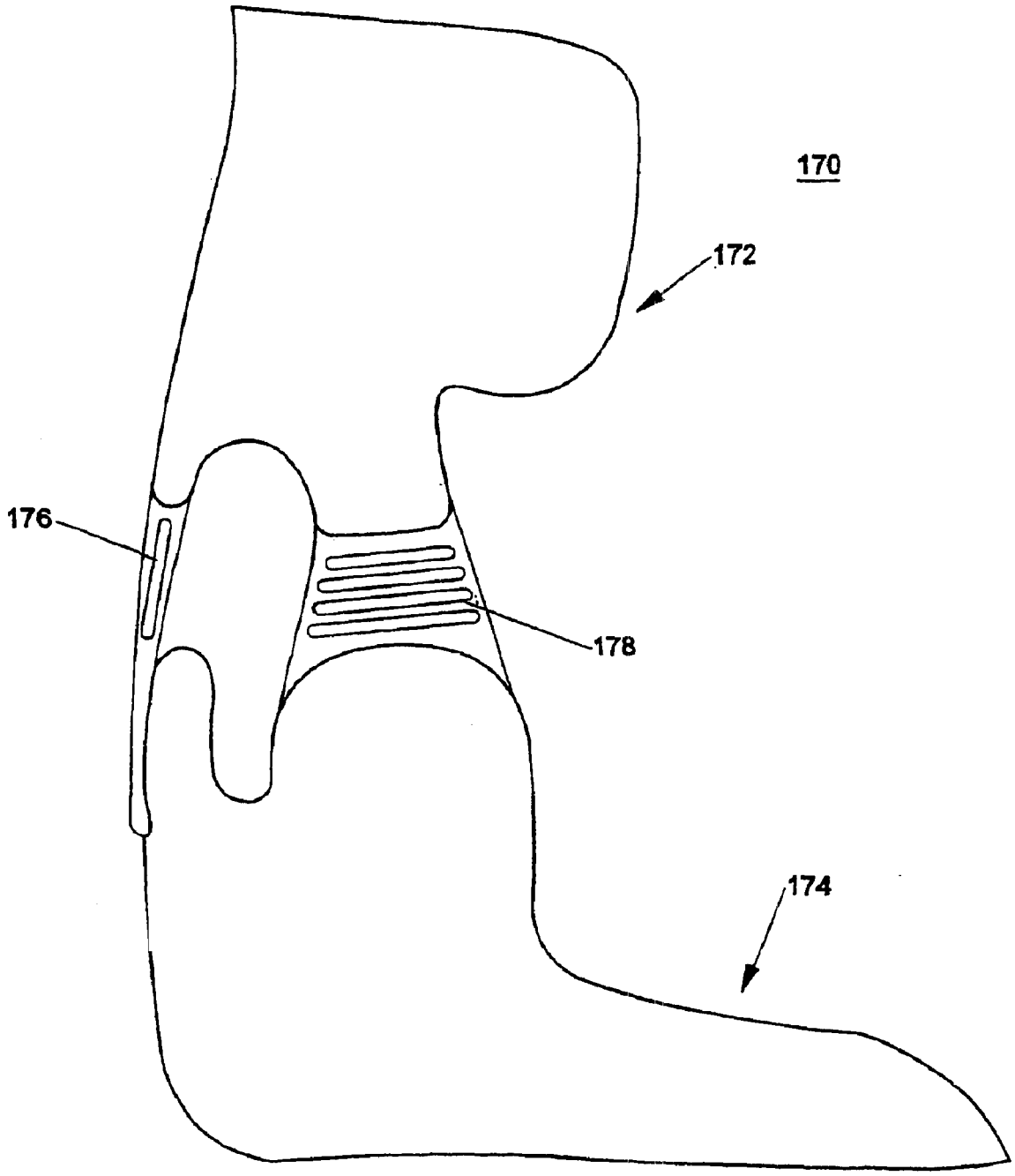
FIG. 8 is a perspective view of a fifth embodiment in which use is made of hinging means of elastomeric materials.

In a final embodiment of the invention, illustrated in FIG. 8, which is notable because of its simplicity, a structure 170, to be associated with a motorcycle boot, consists of a leg-piece 172 connected to a heel-piece 174 by means of first rear hinging means 176 and second front hinging means 178. Both the rear and front hinging means 176 and 178 consist of moulded parts made of elastomeric materials to realize the connection between the leg-piece 172 and the heel-piece 174 in the region of the heel and of the inner side of the ankle joint. The restrictions to axial and angular movements of the two hinging means 176 and 178 are ensured by the physical characteristics of the elastomeric materials chosen for their construction since they able to offer a sufficient protection against injuries involving the Achilles tendon, the malleolar joint and ligaments. This construction is also remarkable for a decidedly lower cost than the four embodiments illustrated in FIGS. 1 to 7.

Moreover, it should be noted that the use of hinging means 176 and 178 made of elastomeric materials has the further advantage of not requiring any additional thicker zone on the leg-piece 172 and heel-piece 174. Consequently, the fifth embodiment of the invention allows simplifications in the design of an inner shoe, to be positioned between the structure 170, the leg and foot.

It is finally to remark that the above described embodiments of the invention shall not be considered in a limiting sense, the scope of the invention being defined only by the following claims.

What is claimed is:

1. A structure associated with a motorcycle boot having a heel region and a malleolus region, comprising:

at least one leg-piece hingedly connected with at least one heel-piece so that the at least one leg-piece is axially and angularly movable relative to the at least one-heel piece, a first hinge provided between the at least one leg-piece and the at least one heel-piece and positioned close to the heel region, wherein the first hinge limits axial movement but does not restrict angular movement of the at least one leg-piece relative to the at least one heel-piece, and a second hinge provided between the at least one leg-piece and the at least one heel-piece and positioned close to the malleolus region, wherein the second hinge restricts angular movement of the at least one leg-piece relative to the at least one heel-piece, wherein the second hinge further comprises at least one arch-shaped tongue centred on the first hinge that projects from the at least one leg-piece, said at least one arch-shaped tongue being slidable under a raised bridge protruding from the at least one heel-piece, and wherein the at least one arched-shaped tongue is provided with at least first upper stopping means, which restrict angular movement of the at least one leg-piece during closing of the motorcycle boot, and second lower stopping means which restrict such movement during opening of the motorcycle boot.

2. A structure according to claim 1, wherein the at least one upper stopping means further comprise two widened zones at a base of the at least one arched-shaped tongue, which zones rest against two outer ends of said raised bridge, and wherein the second lower stopping means further comprise a thicker zone of said at least one arch-shaped tongue, which thicker zone projects from a tip thereof and can be engaged against a bottom edge of said raised bridge.

3. A structure associated with a motorcycle boot having a heel region and a malleolus region, comprising:

at least one leg-piece hingedly connected with at least one heel-piece so that the at least one leg-piece is axially and angularly movable relative to the at least one-heel piece, a first hinge provided between the at least one leg-piece and the at least one heel-piece and positioned close to the heel region, wherein the first hinge limits axial movement but does not restrict angular movement of the at least one leg-piece relative to the at least one heel-piece, and a second hinge provided between the at least one leg-piece and the at least one heel-piece and positioned close to the malleolus region, wherein the second hinge restricts angular movement of the at least one leg-piece relative to the at least one heel-piece, wherein the second hinge further comprises at least one arch-shaped tongue centred on the first hinge that projects from the at least one leg-piece and is curved inward in a spherical manner and is slidable into a pocket having a shape matching that of the at least one arch-shaped tongue, said pocket provided in the at least one heel-piece, and wherein the at least one arch-shaped tongue is provided with stopping means for restricting the angular movement during closing and with a dampening system for dampening the angular movement during opening.

4. A structure according to claim 3, wherein the stopping means further comprises two widened of the at least one arch-shaped tongue that engage against an upper edge of the pocket, and the dampening system further comprises the spherical curvature of both the at least one arch-shaped tongue and the pocket.

5. A structure according to claim 3, wherein the stopping means is formed by a bottom of the pocket and the dampening system is formed by the spherical curvature of both the at least one arch-shaped tongue and the pocket.

* * * * *

UNITED STATES PATENT AND TRADEMARK OFFICE

CERTIFICATE OF CORRECTION

PATENT NO. : 6,883,256 B2
APPLICATION NO. : 10/829030
DATED : April 26, 2005
INVENTOR(S) : Mazzarolo It is certified that error appears in the above-identified patent and that said Letters Patent is hereby corrected as shown below:

On the title page item (75),
The inventor name will be changed from "Gabriele Mazzarolo"
to --Giovanni Mazzarolo--

Signed and Sealed this

Third Day of April, 2007

JON W. DUDAS
*Director of the United States Patent and Trademark Office*